US007147086B2

(12) United States Patent
Ach

(10) Patent No.: US 7,147,086 B2
(45) Date of Patent: Dec. 12, 2006

(54) GUIDE RAIL ARRANGEMENT FOR ELEVATORS

(75) Inventor: Ernst Friedrich Ach, Ebikon (CH)

(73) Assignee: Inventio AG, Hergiswil (CH)

( * ) Notice: Subject to any disclaimer, the term of this patent is extended or adjusted under 35 U.S.C. 154(b) by 254 days.

(21) Appl. No.: 10/325,358

(22) Filed: Dec. 19, 2002

(65) Prior Publication Data

US 2003/0116386 A1 Jun. 26, 2003

(30) Foreign Application Priority Data

Dec. 20, 2001 (EP) ..... 01811247

(51) Int. Cl.
*B66B 7/02* (2006.01)

(52) U.S. Cl. ..... 187/408; 187/406

(58) Field of Classification Search ..... 187/406, 187/408, 249, 404; 52/29
See application file for complete search history.

(56) References Cited

U.S. PATENT DOCUMENTS 957,531 A * 5/1910 Winslow ..... 403/217
1,051,335 A * 1/1913 King ..... 187/408
1,702,783 A * 2/1929 Kiesling ..... 187/408
3,601,938 A * 8/1971 Loomis ..... 52/29
3,880,258 A * 4/1975 Rompa ..... 187/239
3,948,358 A 4/1976 Atkey
5,119,908 A * 6/1992 Korhonen ..... 187/408
5,520,264 A * 5/1996 Korhonen ..... 187/408
5,833,031 A * 11/1998 Liebetrau et al. ..... 187/239
6,446,762 B1 * 9/2002 St. Pierre et al. ..... 187/406
6,481,538 B1 * 11/2002 Blackaby et al. ..... 187/408
6,672,013 B1 * 1/2004 Glassey et al. ..... 52/30

FOREIGN PATENT DOCUMENTS

EP 0 643 007 4/1999

* cited by examiner

*Primary Examiner*—Kathy Matecki
*Assistant Examiner*—Sang Kim
(74) *Attorney, Agent, or Firm*—Butzel Long

(57) ABSTRACT

A guide rail arrangement for avoiding the costly and time-consuming aligning of the guide rails for a counterweight and an elevator car includes guide rails fastened to a mounting bracket connected with the shaft wall at the door side. The guide rails of two counterweights are held by double claws that are fastened to the mounting bracket by only one screw.

15 Claims, 3 Drawing Sheets

GUIDE RAIL ARRANGEMENT FOR ELEVATORS

BACKGROUND OF THE INVENTION

The invention relates to a guide rail arrangement for elevators, wherein mounting brackets, to which guide rails for an elevator car are fastened, are provided at a door side wall of an elevator shaft.

A guide rail arrangement as described above is shown the U.S. Pat. No. 3,948,358. A mounting bracket, which is U-shaped in outline, in that case consists of a transverse beam in the form of a U-profile member, the ends of which are connected with girders which extend parallel to one another and project into the elevator shaft and which similarly consist of U-profile members. Guide rails for the guidance of an elevator car are fastened to the girders, at the same spacing from the transverse beam, by means of claws. Arranged in turn at the transverse beam are angle brackets which are adjustable in two directions and the horizontal limbs of which are fastened, resting on projections of the masonry supporting the door threshold and the door frame of a shaft door, to this masonry. The horizontal limbs for this purpose have slots so that during the fastening the spacing between the masonry and the transverse beam of the mounting bracket can be set. The transverse beam is, in addition, connected by way of bolts and by way of a Z-shaped retaining element with the door threshold and the door frame, whereby a spacing between the elevator car and the door threshold is ensured. With this guide rail arrangement, the costly and time-consuming alignment of the guide rails for an elevator car in the case of shaft walls that do not extend exactly vertically and parallel to one another are avoided.

SUMMARY OF THE INVENTION

The present invention has the object of proposing an improved guide rail arrangement for elevators, through the use of which the mounting time can be further reduced and mounting errors avoided.

In that case, proceeding from the aforesaid state of the art, there are fastened to a mounting bracket, apart from the guide rails for an elevator car, also guide rails for at least one counterweight. In a preferred embodiment, guide rails for two counterweights are provided, wherein the guide rails are held at the mounting bracket by means of double claws which are fastened to the mounting bracket by only a single screw.

The advantages achieved by the arrangement according to the present invention are that the proposed arrangement of the counterweight guide rails is space saving and thus enables minimum shaft dimensions. As in the case of the guide rails for the elevator car, no time-consuming and costly aligning, as would be necessary in the case of fastening to not exactly vertical and not parallel shaft walls, is required, wherein a further reduction in mounting time is achieved by the double claws for retaining the counterweight guide rails. Another advantage resides in the fact that the sole interface of the guide rail arrangement relative to the elevator shaft is the shaft wall at the door side, so that the elevator shaft at the building side can be designed independently of the elevator installation. The further proposed corner profile members enable a simple and quick fastening of the mounting brackets in any desired position and during the mounting can be used with advantage as a support for a mounting platform.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
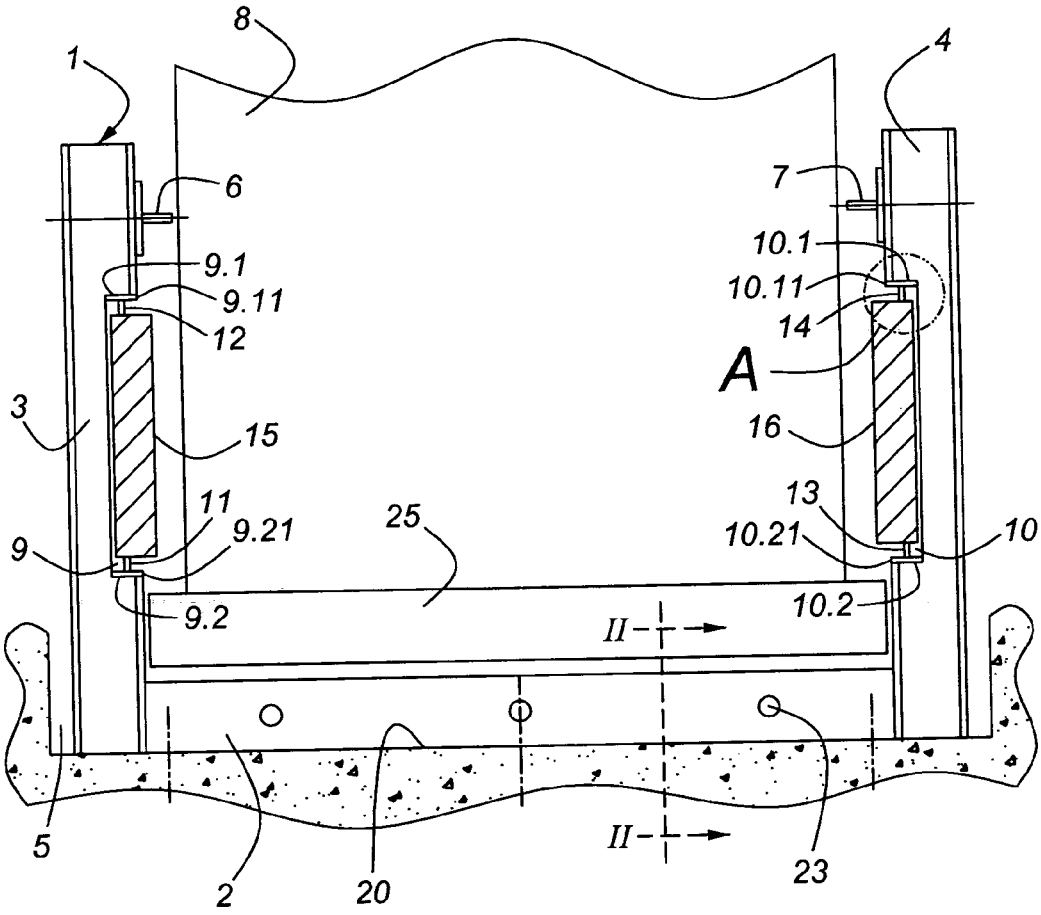
FIG. 1 is a fragmentary cross-sectional schematic view of an elevator shaft with a guide rail arrangement according to the present invention.
Figure 2:
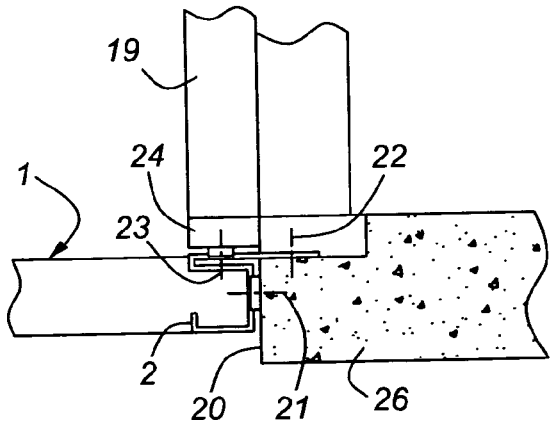
FIG. 2 is a cross-sectional view taken along the line II—II in FIG. 1.
Figure 4:
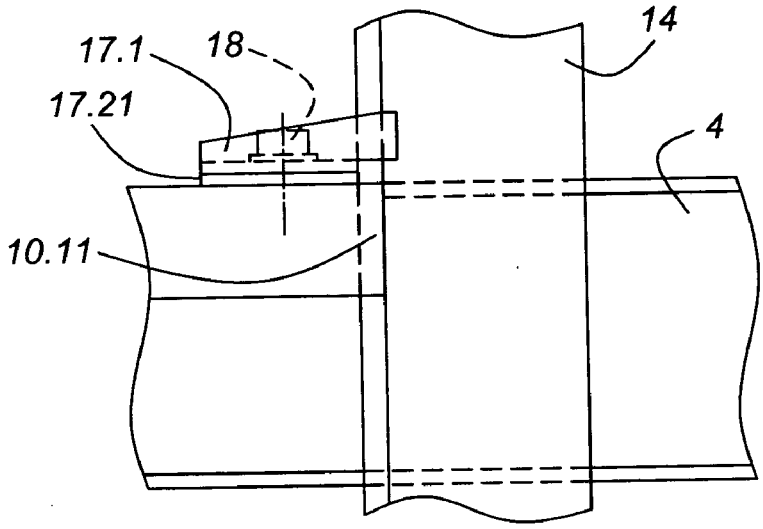
FIG. 4 is a view in the direction of the arrow in FIG. 3.
Figure 3:
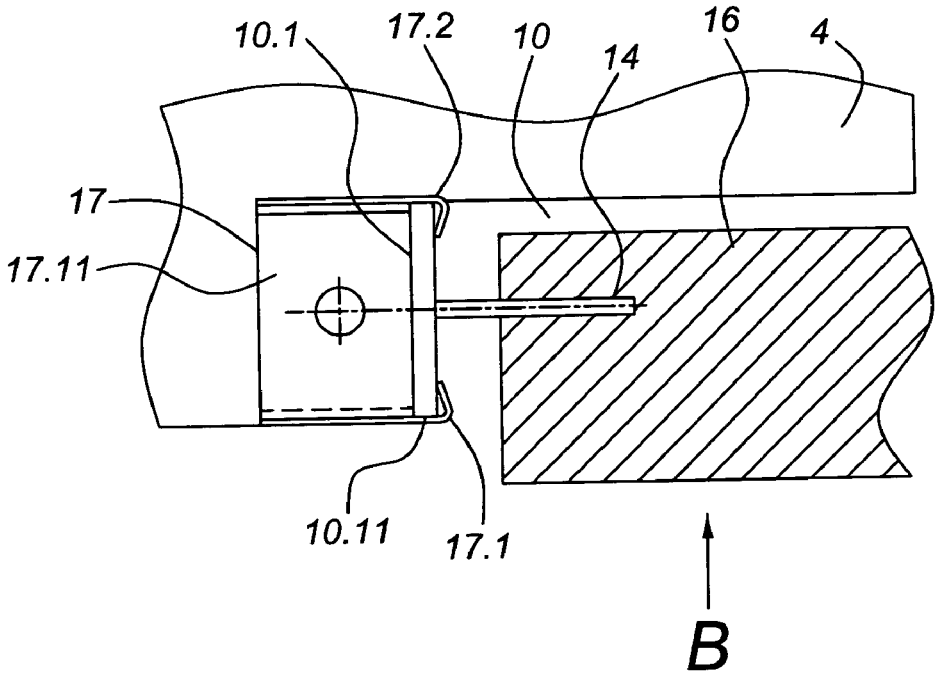
FIG. 3 is an enlarged view of the detail A in FIG. 1.

In FIGS. 1 to 4, a generally U-shaped mounting bracket 1 includes a transverse beam 2 and two girders 3, 4 that are attached to and extend from the opposite ends of the transverse beam. The girders 3, 4 project parallel to one another into an elevator shaft 5. The transverse beam 2 and the girders 3, 4 can consist of, for example, profile members that are welded together, screwed together or connected together in another manner. The entire mounting bracket 1 could also be constructed as, for example, a one-piece pressed part (stamped part). Guide rails 6,7 for an elevator car 8 are fastened to the girders 3, 4 by means of claws (not illustrated). The girders 3, 4 have cutouts 9, 10 in which guide rails 11, 12 for the car 8 and guide rails 13, 14 for counterweights 15, 16 are arranged. As seen particularly in FIG. 4, the cutouts 9, 10 have abutments 9.11, 9.21 and 10.11, 10.21 laterally of two support edges 9.1, 9.2 and 10.1, 10.2 for the guide rails 11, 12, 13, 14, so that the guide rails adopt a centered position at three sides in the cutouts 9, 10, wherein they are held by double claws 17. The double claws 17 each consists of a right-hand and a left-hand claw part 17.1, 17.2 respectively with associated flanges 17.11, 17.21, which, resting one on the other, are fastened by a screw 18 to the girders 3, 4.

The mounting bracket 1 is fastened at its transverse beam 2 to a shaft wall 20 at the door side, preferably below a shaft door 19 in the region of the usually present floor concrete plate 26. The fastening elements used for this purpose are symbolized in FIG. 2 by dot-dash lines 21, 22. Bores 23 for reception of the fastening bolts of a door threshold 24 are provided in the transverse beam 2. The mounting bracket 1 thus additionally forms the support construction for the shaft door 19. On installation of the elevator in an elevator shaft, the mounting brackets 1 and thus the shaft door threshold 24 are aligned with the help of plumb lines extending over the entire shaft height. By this method the correct spacing between the door threshold 24 with the shaft door 19 guided thereon on the one hand and the elevator car 8 or the car door 25 mounted thereon on the other hand can be precisely maintained without additional aligning operations.

Figure 5:
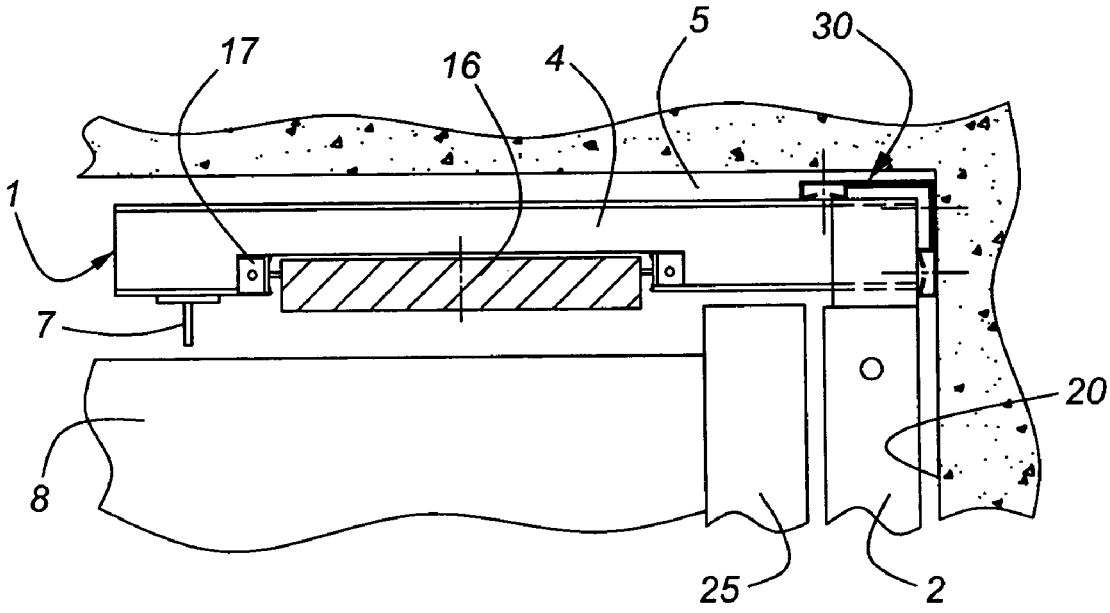
FIG. 5 is a partial cross-section of the elevator shaft with an alternate embodiment of the fastening of a mounting bracket of the guide rail arrangement according to the present invention.
Figure 6:
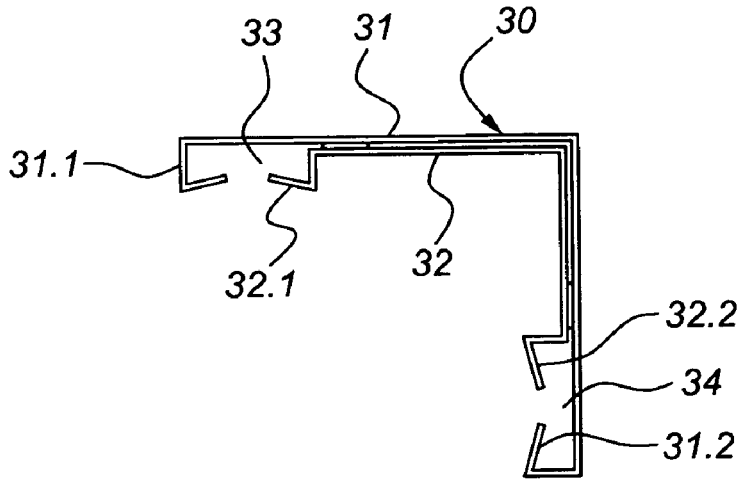
FIG. 6 is an enlarged cross-sectional view of the fastening shown in FIG. 5.

According to FIGS. 5 and 6 the mounting bracket 1 is fastened to two corner profile members 30 that extend approximately over the entire shaft height and which are mounted on both sides of the mounting bracket 1 to the shaft wall 20 at the door side. These corner profile members 30 are supported at the base of the elevator shaft 5 and fastened to be displaceable in a vertical direction relative to the shaft wall, in particular so that distortions between the shaft wall and the corner profile members 30 due to contraction of the building can be avoided. The corner profile member 30 consists of an outer angle iron 31 and an inner angle iron 32 which are firmly connected together by, for example, welding. The ends of the limbs of the outer angle iron 31 have approximately U-shaped bent-over portions 31.1, 31.2, while the ends of the limbs of the inner angle iron 32 are formed into approximately Z-shaped bent-over portions 32.1, 32.2. On joining together of the angle irons 31, 32, groove rails 33, 34 are formed by the bent-over portions 31.1, 32.1 or 31.2, 32.2. The mounting bracket 1 can be pushed into a desired position by means of screws (not illustrated) guided in the grooves rails 33, 34 and can be fixed in this position.

It will be obvious that in the case of elevators with only one counterweight, merely one of the two girders 3 and 4 is equipped with guide rails 11, 12 or 13, 14.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A guide rail arrangement for elevators comprising:

a mounting bracket attached to elevator car guide rails and being adapted to be fastened to a wall at a door side of an elevator shaft, and guide rails for at least one counterweight, said guide rails being arranged separate from the elevator car guide rails and attached to said mounting bracket whereby when said mounting bracket is fastened to the door side elevator shaft wall, a girder portion of said mounting bracket to which said elevator car guide rails and said counterweight guide rails are attached extends transverse to the door side elevator shaft wall.

2. The guide rail arrangement according to claim 1 including guide rails for two counterweights attached to said mounting bracket.

3. The guide rail arrangement according to claim 1 wherein said mounting bracket includes a transverse beam and two girders each attached to an associated end of said beam, said girders extending at right angles to said beam and parallel to one another into the elevator shaft, said guide rails for the at least one counterweight being attached to one of said girders.

4. The guide rail arrangement according to claim 3 wherein said one of said girders has a cutout formed therein in which said guide rails for the at least one counterweight are arranged.

5. The guide rail arrangement according to claim 4 wherein said cutout has abutments extending laterally of two support edges for centering said guide rails for the at least one counterweight in said cutout.

6. The guide rail arrangement according to claim 3 wherein said guide rails for the at least one counterweight are held at said one of said girders by double claws.

7. The guide rail arrangement according to claim 6 wherein said double claws each include a right-hand claw part and a left-hand claw part, said claw parts having associated flanges that are fastened, one resting on the other, to said girders by a screw.

8. The guide rail arrangement according to claim 3 wherein said transverse beam is fastened to the wall of the elevator shaft in a region of a floor concrete plate.

9. The guide rail arrangement according to claim 1 wherein said mounting bracket is constructed as a support for shaft doors of the elevator shaft.

10. The guide rail arrangement according to claim 1 wherein said mounting bracket is fastened to two corner profile members which are mounted in a region of the door side elevator shaft wall, at both sides of said mounting brackets and said members extend approximately over an entire height of the shaft.

11. The guide rail arrangement for elevators according to claim 10 wherein said two corner profile members are supported at a base of the elevator shaft and are fastened for displacement in vertical direction relative to the door side elevator shaft wall.

12. The guide rail arrangement according to claim 10 wherein said corner profile members include an outer angle iron and an inner angle iron, which said angle irons are fixedly connected together, and ends of limbs of said outer angle iron have approximately U-shaped bent-over portions and ends of limbs of said inner angle iron have approximately Z-shaped bent-over portions, associated ones of said U-shaped bent-over portions and said Z-shaped bent-over portions forming groove rails for accepting a screw.

13. A guide rail arrangement for elevators comprising:

a mounting bracket attached to elevator car guide rails and fastened in a region of a wall at a door side of an elevator shaft in a building, said mounting bracket including a transverse beam and two girders each attached to an associated end of said beam, said girders extending at right angles to said beam and parallel to one another into the elevator shaft, each of said girders having a cutout formed therein; and guide rails for two counterweights positioned in associated ones of said cutouts and attached to said mounting bracket.

14. The guide rail arrangement according to claim 13 wherein said guide rails for the counterweights are held at said girders by double claws.

15. The guide rail arrangement according to claim 14 wherein said double claws are each fastened to an associated one of said girders by a single screw.

* * * * *